US007775077B2

(12) United States Patent
Mishima et al.

(10) Patent No.: US 7,775,077 B2
(45) Date of Patent: Aug. 17, 2010

(54) CLOSING METHOD AND CLOSING MACHINE

(75) Inventors: Keisuke Mishima, Tokyo (JP); Shigetoshi Ogiso, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 246 days.

(21) Appl. No.: 11/887,270

(22) PCT Filed: Mar. 31, 2006

(86) PCT No.: PCT/JP2006/307386

§ 371 (c)(1),
(2), (4) Date: Sep. 27, 2007

(87) PCT Pub. No.: WO2006/104272

PCT Pub. Date: Oct. 5, 2006

(65) Prior Publication Data

US 2009/0133458 A1 May 28, 2009

(30) Foreign Application Priority Data

Mar. 31, 2005 (JP) ..... 2005-101821

(51) Int. Cl.

| | |
|---|---|
| ***B21D 41/04*** | (2006.01) |
| ***B23Q 3/00*** | (2006.01) |
| ***B25B 27/14*** | (2006.01) |
| ***B21B 15/00*** | (2006.01) |

(52) U.S. Cl. ..... 72/125; 72/80; 72/370.12; 269/309; 29/281.1

(58) Field of Classification Search ..... 72/84, 72/85, 112, 115, 125, 370.1, 370.12, 80, 72/82, 428, 419, 420, 421, 361; 269/309, 269/310; 29/281.1
See application file for complete search history.

(56) References Cited

U.S. PATENT DOCUMENTS

| | | | | |
|---|---|---|---|---|
| 7,219,520 | B2 * | 5/2007 | Massee | 72/83 |
| 2003/0154600 | A1 | 8/2003 | Umeda et al. | |

FOREIGN PATENT DOCUMENTS

| | | |
|---|---|---|
| JP | 2002-153930 | 5/2002 |
| JP | 2002-192277 | 7/2002 |
| JP | 2003-200241 | 7/2003 |
| JP | 2005-342725 | 12/2005 |

* cited by examiner

*Primary Examiner*—Dana Ross
*Assistant Examiner*—Debra M Sullivan
(74) *Attorney, Agent, or Firm*—Rabin & Berdo, P.C.

(57) ABSTRACT

In a closing machine (1), an inner diameter chuck (8) that grips an inner peripheral surface of a work piece (9), a work piece (9) introducing device that moves the inner diameter chuck (8) in a Y axis direction of the work piece (9), and an introduction stopper (12) that projects onto an introduction path of the work piece (9) are used in such a manner that the inner diameter chuck (8) grips the inner peripheral surface of the work piece (9) while the work piece (9) abuts against the introduction stopper (12), the introduction stopper (12) is removed from the introduction path of the work piece (9), and the work piece (9) is introduced into an outer diameter chuck (7) by moving the inner diameter chuck (8) in the Y axis direction of the work piece (9).

5 Claims, 9 Drawing Sheets

CLOSING METHOD AND CLOSING MACHINE

FIELD OF THE INVENTION

This invention relates to an improvement in a closing method and a closing machine for closing an open end of a metal pipe material.

BACKGROUND OF THE INVENTION

In a closing method, a work piece constituted by a metal pipe material is rotated and a die is pressed against the work piece while the work piece is heated. Thus, the work piece undergoes plastic deformation as it gradually approaches the die.

A closing machine used in the closing operation comprises an outer diameter chuck that grips an outer peripheral surface of the work piece, and a chuck spindle that drives the outer diameter chuck to rotate together with the work piece. The work piece is closed by pressing the die against the work piece while rotating the work piece about an axis that is offset from the die by a predetermined offset amount.

The closing method and closing machine described above are disclosed in JP2002-153930A.

A conventional closing machine comprises a work piece introducing device for introducing a work piece into the outer diameter chuck. The work piece introducing device introduces the work piece into the outer diameter chuck by conveying the work piece in an axial direction via a conveyor or the like.

However, in this conventional work piece introducing device, the work piece is introduced into the outer diameter chuck by conveying the work piece in the axial direction via a conveyor or the like, and it is therefore difficult to improve the positional precision with which the work piece is introduced into the outer diameter chuck.

It is therefore an object of this invention to improve the positional precision with which a work piece is introduced into an outer diameter chuck in a closing method and a closing machine.

SUMMARY OF THE INVENTION

This invention provides a closing method for closing an open end of a tubular work piece by holding the work piece in an outer diameter chuck, rotating the outer diameter chuck together with the work piece, and pressing a die against the work piece rotating about an axial center, using an inner diameter chuck that grips an inner peripheral surface of the work piece, a work piece introducing device that moves the inner diameter chuck in an axial direction of the work piece, and an introduction stopper that projects onto an introduction path of the work piece. The method is characterized in comprising: having the inner diameter chuck grip the inner peripheral surface of the work piece while the work piece abuts against the introduction stopper; removing the introduction stopper from the introduction path of the work piece; and introducing the work piece into the outer diameter chuck by moving the inner diameter chuck in the axial direction of the work piece.

This invention also provides a closing machine for closing an open end of a tubular work piece by holding the work piece in an outer diameter chuck, rotating the outer diameter chuck together with the work piece, and pressing a die against the work piece rotating about an axial center, comprising an inner diameter chuck that grips an inner peripheral surface of the work piece, a work piece introducing device that moves the inner diameter chuck in an axial direction of the work piece, and an introduction stopper that projects onto an introduction path of the work piece, characterized in that the inner diameter chuck grips the inner peripheral surface of the work piece while the work piece abuts against the introduction stopper, the introduction stopper is removed from the introduction path of the work piece, and the work piece is introduced into the outer diameter chuck by moving the inner diameter chuck in the axial direction of the work piece.

According to this invention, the inner diameter chuck grips the inner peripheral surface of the work piece while the work piece abuts against the introduction stopper, and therefore, the inner diameter chuck can grip the work piece securely in a predetermined position.

Further, after the inner diameter chuck has gripped the inner peripheral surface of the work piece, the work piece introducing device causes the work piece to advance in the axial direction such that the work piece is introduced into the outer diameter chuck, and thus, the outer diameter chuck can grip the work piece securely in a predetermined position.

By increasing the positional precision with which the outer diameter chuck grips the work piece, the processed shape of the work piece can be kept constant, and the quality can be improved.

DESCRIPTION OF THE PREFERRED EMBODIMENTS

This invention will now be described in further detail with reference to the attached drawings.

Figure 1:
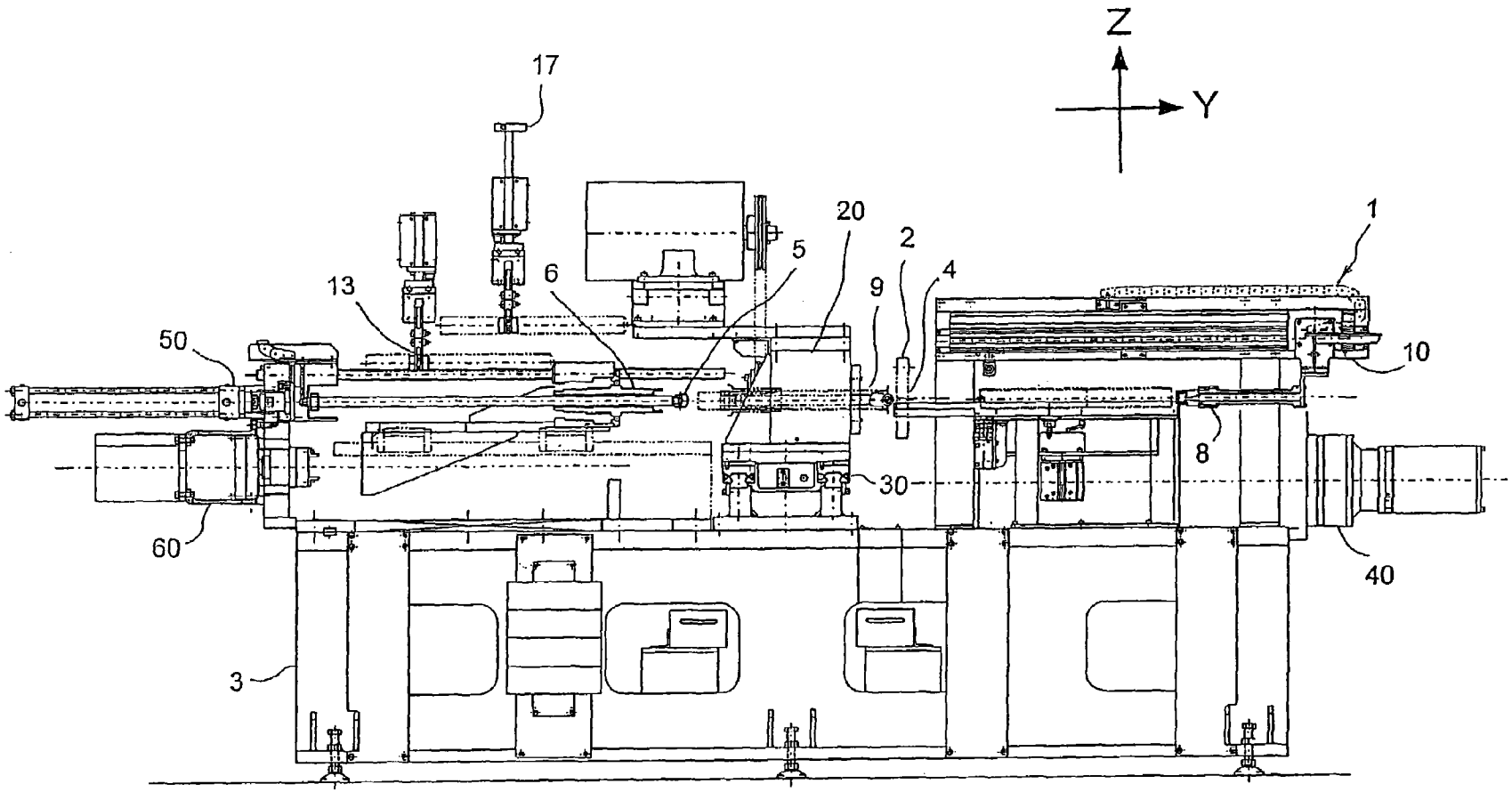
FIG. 1 is a side view of a closing machine, illustrating an embodiment of this invention.
Figure 2:
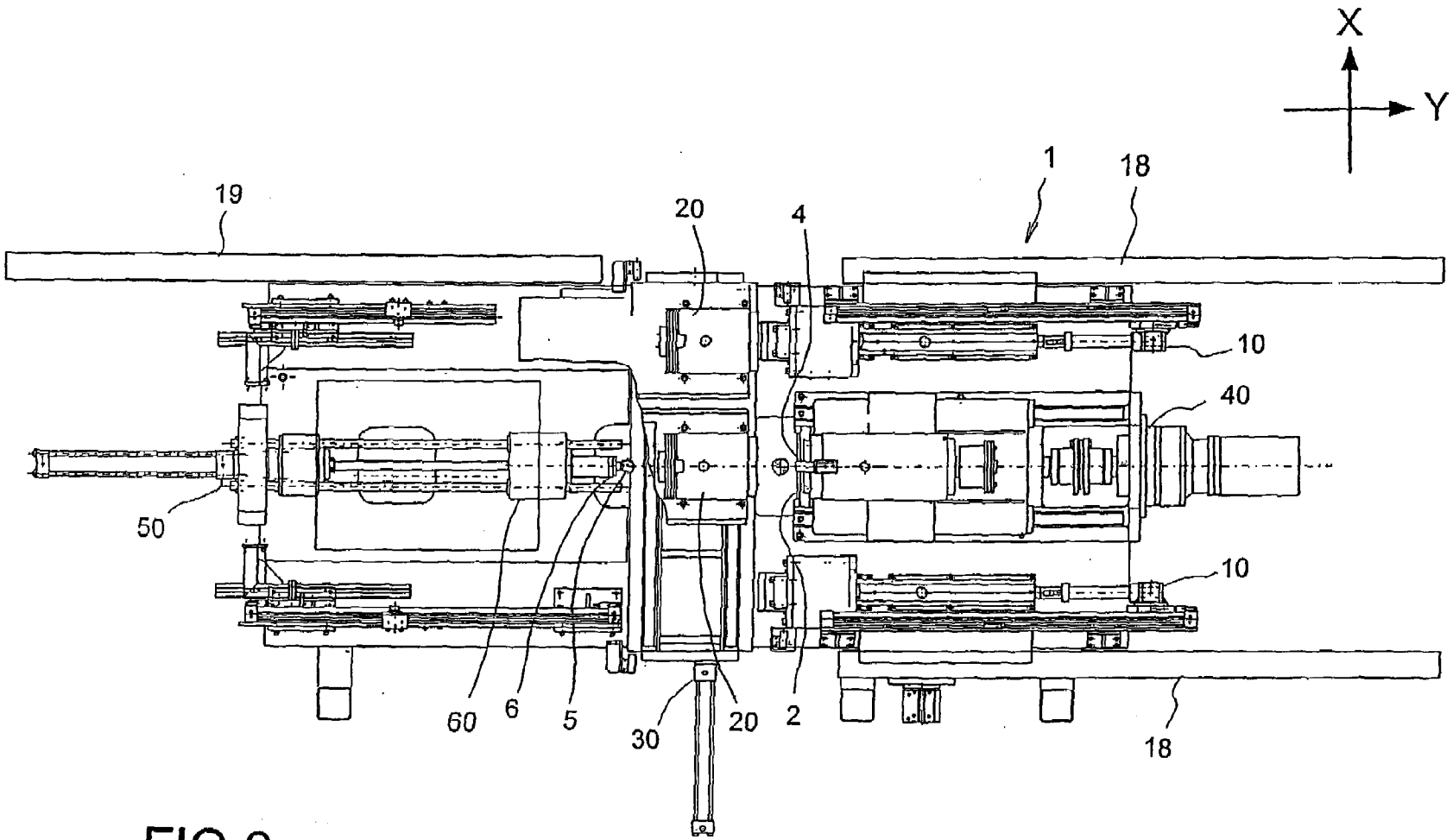
FIG. 2 is a plan view of the closing machine.
Figure 3:
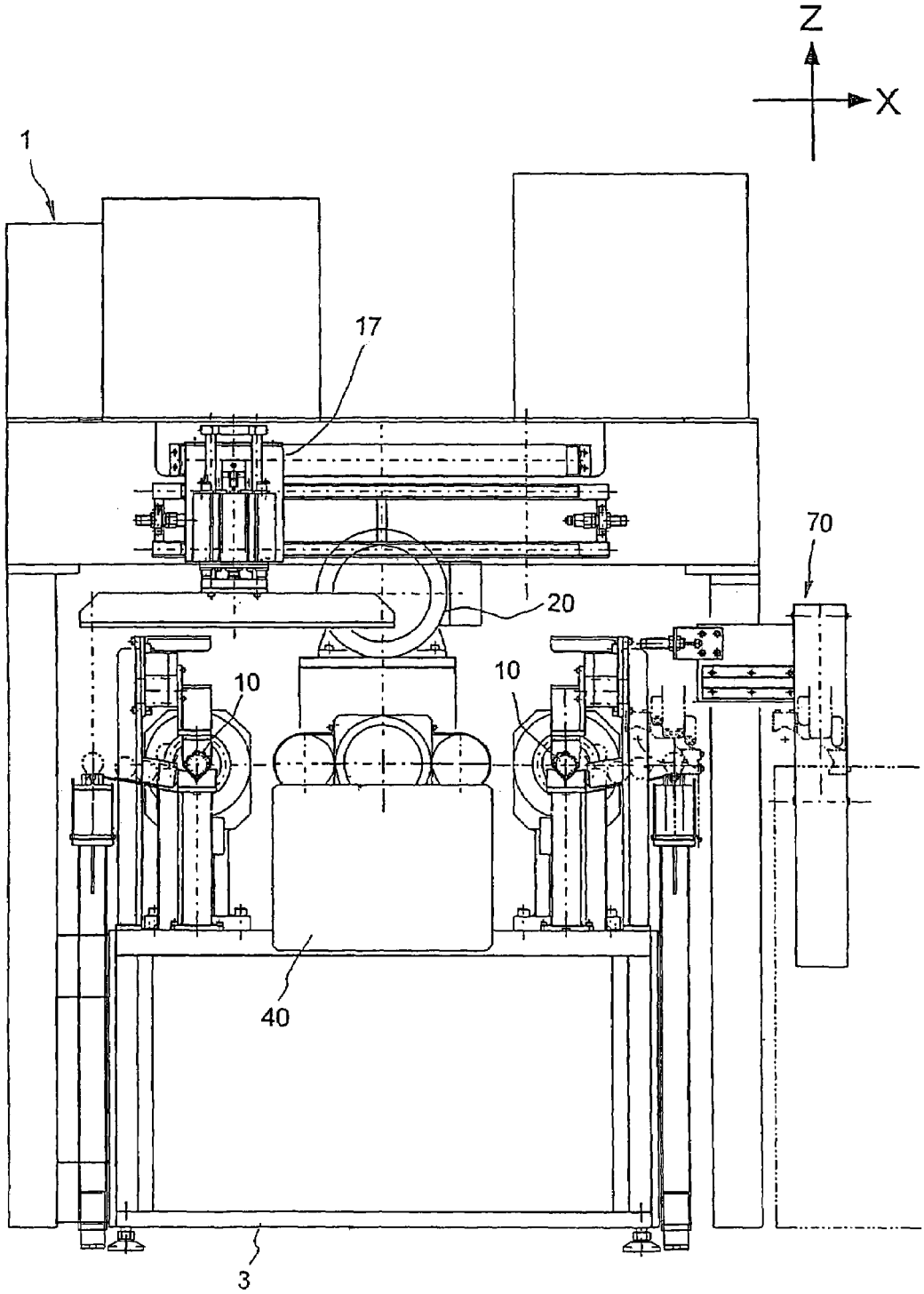
FIG. 3 is a front view of the closing machine.

FIGS. 1 to 3 show the overall constitution of a closing machine 1. In FIGS. 1 to 3, three axes, namely X, Y, and Z, are set orthogonal to each other. It is assumed that the X axis extends in a substantially horizontal lateral direction, the Y axis extends in a substantially horizontal front-rear direction, and the Z axis extends in a substantially vertical direction. The overall constitution of the closing machine 1 will now be described.

Two chuck spindles 20 which drive a work piece 9 to rotate about its axial center, and a single die driving device 40 which drives a die 4, are provided in a central portion of the closing machine 1. The chuck spindles 20 perform a reciprocating motion in the X axis direction relative to a pedestal 3 via a chuck spindle moving device 30, to be described later, thereby moving alternately to the central portion of the closing machine 1 so as to bring the work piece 9 face to face with the die 4.

The closing machine 1 performs a closing operation to close an open end of the work piece 9 by heating the work piece 9, which is constituted by a metal pipe material, using a high-frequency heating device 2, and pressing the die 4 against the rotating work piece 9 such that the work piece 9 undergoes plastic deformation.

A thrust stopper moving device 60, which is positioned in front of the chuck spindle 20 for closing the work piece 9 so as to support an end portion of the work piece 9, and a core moving device 50, which moves a core 5 inside the work piece 9, are provided in the central portion of the closing machine 1.

A pair of conveyors 18 and a work piece introducing device 10 are provided respectively on the left and right rear portions of the working machine 1. The work piece 9 is conveyed forward in the Y axis direction by each of the conveyors 18 and then conveyed forward in the Y axis direction by each of the work piece introducing devices 10, which are capable of movement in the Y axis direction. Thus, the work piece 9 is introduced into and gripped by the respective left and right chuck spindles 20.

While one of the chuck spindles 20 is positioned in the central portion of the working machine 1 during a closing operation, the other chuck spindle 20 is positioned on either the left or right end portion of the closing machine 1 so as to receive the work piece 9 conveyed by the respective work piece introducing devices 10.

A discharge device 17 for discharging the work piece 9 following the closing operation is provided at the front portion of the closing machine 1. The discharge device 17 causes a hand 13 gripping the work piece 9 to reciprocate in the X axis direction relative to the pedestal 3 such that the work piece 9, which is pushed out from the left and right chuck spindles 20, is conveyed to a conveyor 19 disposed on the right-hand front portion of the closing machine 1.

Once the closing operation is complete, the work piece 9, which is at a high temperature of 1000° C. or more, is conveyed to a cooling device 70 (see FIG. 3) by the conveyor 19 and cooled by the cooling device 70. The cooling device 70 is provided on the front right side of the closing machine 1.

FIGS. 4A to 4G show a series of processes performed by the closing machine 1 to close the work piece 9. Each process of this closing method will now be described in sequence.

Figure 4A:
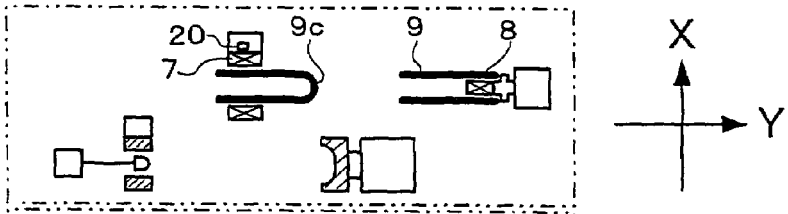
FIGS. 4A to 4H are views showing closing processes.

Referring to FIG. 4A, an inner diameter chuck 8 of the work piece introducing device 10 is inserted into the work piece 9 such that the inner diameter chuck 8 grips the inner peripheral surface of the work piece 9.

Figure 4B:
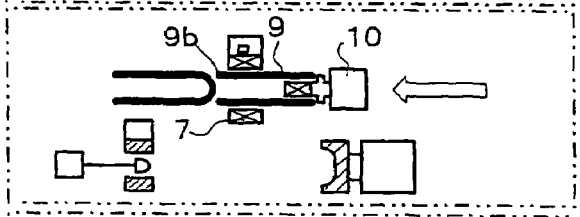

Referring to FIG. 4B, the work piece introducing device 10 causes the inner diameter chuck 8 to advance in the Y axis direction such that the work piece 9 is inserted into an outer diameter chuck 7 of the chuck spindle 20. Thus, the outer diameter chuck 7 grips the outer peripheral surface of the work piece 9.

Figure 4C:
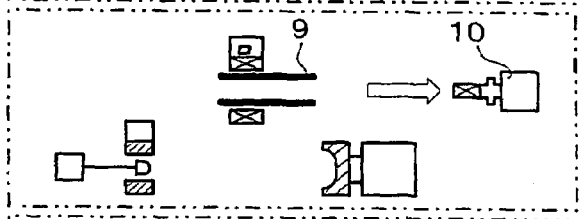

Referring to FIG. 4C, the work piece introducing device 10 causes the inner diameter chuck 8 to retreat in the Y axis direction such that the inner diameter chuck 8 is extracted from the work piece 9. Next, the chuck spindle moving device 30 moves the chuck spindle 20 in the X axis direction until the work piece 9 is stopped in an operation position facing the die 4.

Figure 4D:
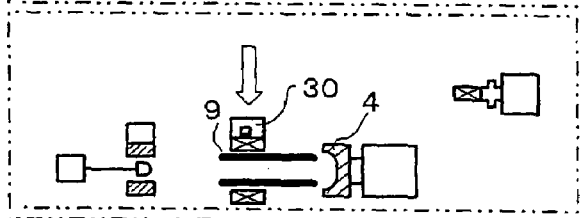

Referring to FIG. 4D, the thrust stopper moving device 60 moves a thrust stopper 6 to a thrust operation reference position supporting a base end portion 9*b* of the work piece 9.

Figure 4E:
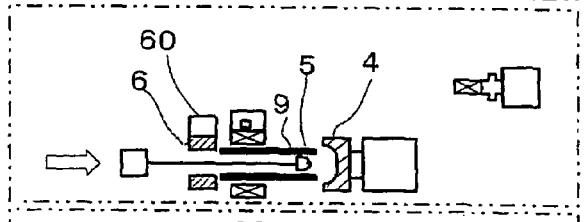

Referring to FIG. 4E, the core moving device 50 introduces the core 5 into the inside of the work piece 9.

Figure 4F:
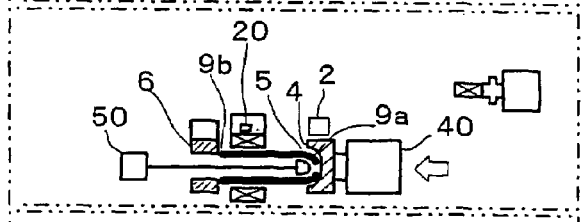

Referring to FIG. 4F, the chuck spindle 20 drives the work piece 9 and the core 5 to rotate. Meanwhile, the die 4 is pressed against the heated work piece 9 by the die driving device 40. Thus, a tip end portion 9*a* of the work piece 9 is steadily reduced in diameter between the die 4 and the core 5 such that finally, the tip end portion 9*a* of the work piece 9 closes to form a bottom portion 9*c*.

Figure 4G:
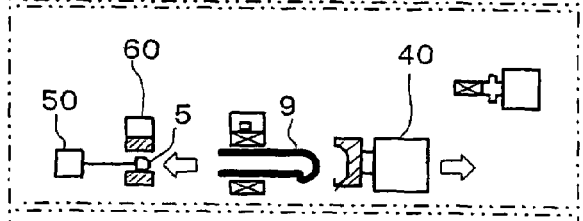

Referring to FIG. 4G, the die driving device 40 moves the die 4 rearward in the Y axis direction away from the work piece 9. Meanwhile, the thrust stopper moving device 60 moves the thrust stopper 6 forward in the Y axis direction away from the thrust operation reference position, and the core moving device 50 removes the core 5 from the inside of the work piece 9.

To close another work piece 9 thereafter, the chuck spindle moving device 30 moves the chuck spindle 20 in the X axis direction such that the work piece 9 faces the inner diameter chuck 8, as shown in FIG. 4A. Then, as shown in FIG. 4B, the work piece introducing device 10 causes the inner diameter chuck 8 to advance in the Y axis direction such that the base end portion 9*b* of the unclosed work piece 9 abuts against the bottom portion 9*c* of the closed work piece 9, and thus the closed work piece 9 is pushed out of the outer diameter chuck 7.

Figure 4H:
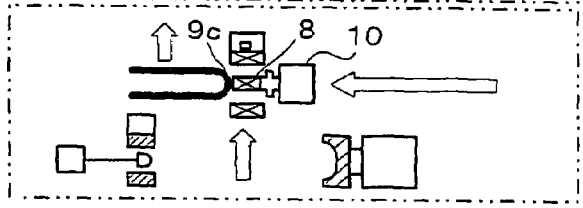

To terminate the closing operation of the work piece 9, the work piece introducing device 10 causes the inner diameter chuck 8 to advance in the Y axis direction, as shown in FIG. 4H, such that the inner diameter chuck 8 abuts against the bottom portion 9*c* of the closed work piece 9, and thus the closed work piece 9 is pushed out of the outer diameter chuck 7.

The overall constitution of the closing machine 1 was described above.

Next, referring to FIGS. 5-7, a constitution by which the closing machine 1 introduces the work piece 9 into the outer diameter chuck 7 will be described.

The closing machine 1 comprises the inner diameter chuck 8, which holds an inner peripheral surface of the work piece 9, the work piece introducing device 10, which introduces the work piece 9 into the outer diameter chuck 7 by moving the inner diameter chuck 8 in the Y axis direction of the work piece 9 relative to the pedestal 3, and an introduction stopper 12 which projects onto an introduction path of the work piece 9.

The closing machine 1 operates such that the inner diameter chuck 8 grips the inner peripheral surface of the work piece 9 while the work piece 9 abuts against the introduction stopper 12, the introduction stopper 12 is removed from the introduction path of the work piece 9, and the inner diameter chuck 8 is moved such that the work piece 9 is introduced into the outer diameter chuck 7.

Figure 5:
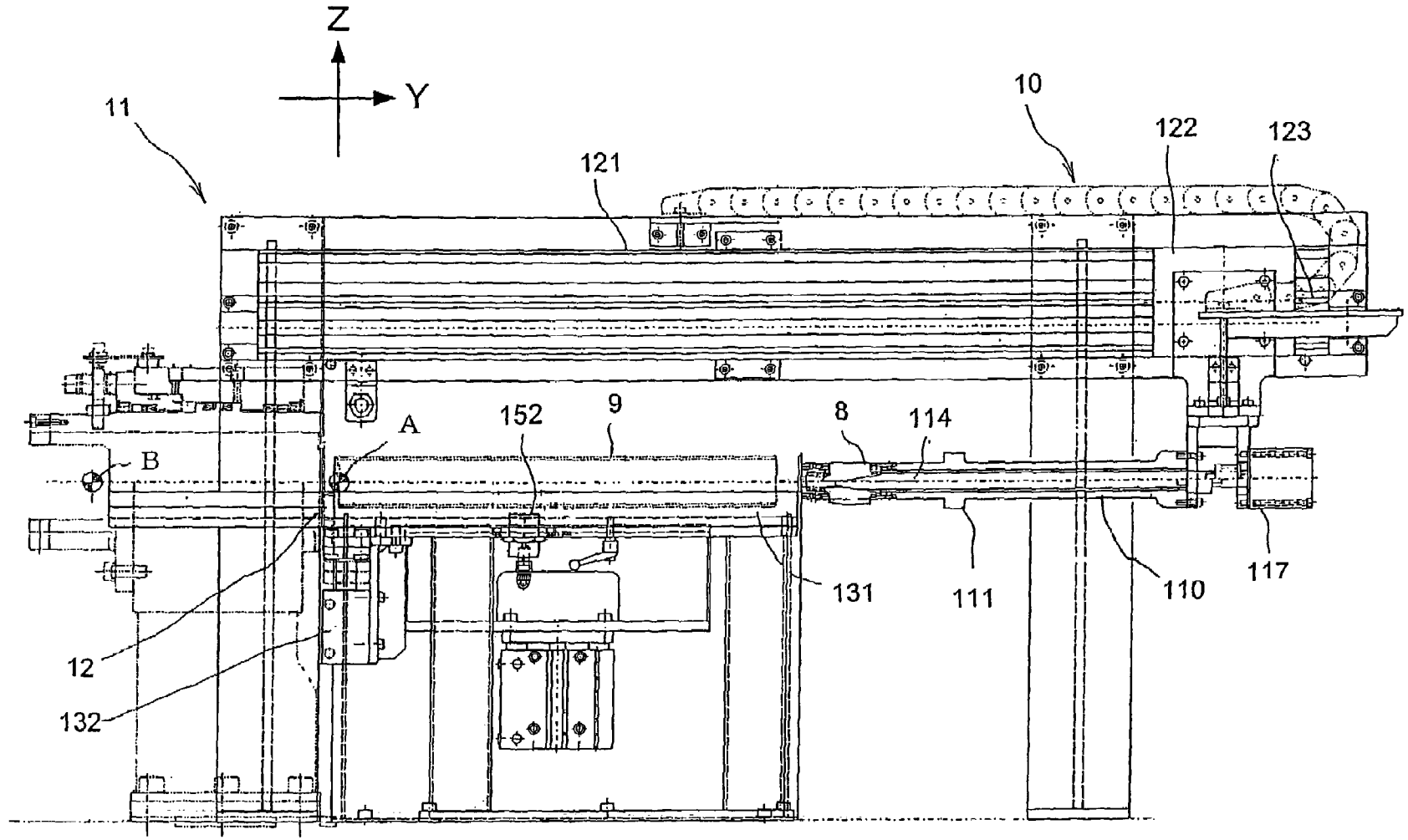
FIG. 5 is a side view of the closing machine.
Figure 6:
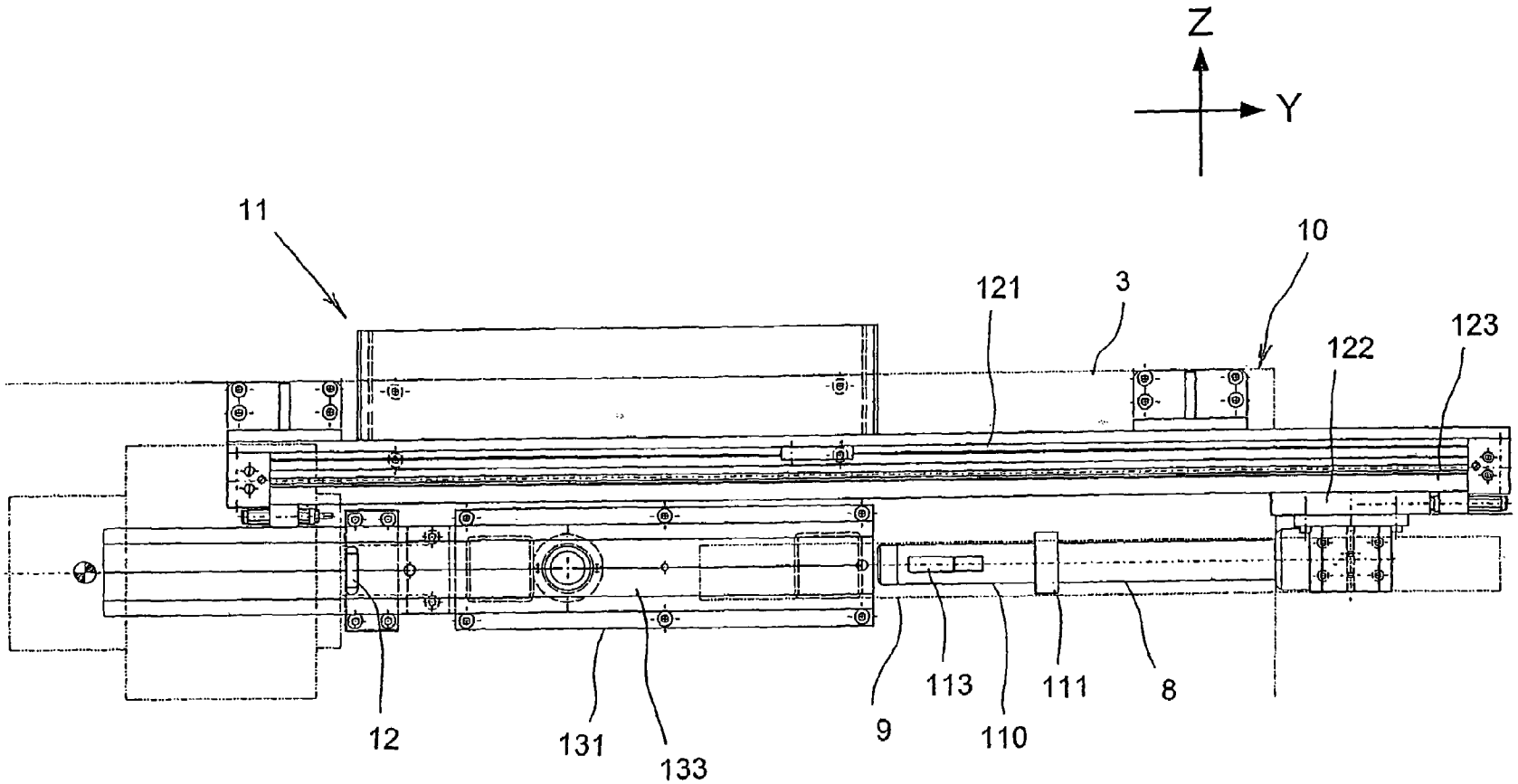
FIG. 6 is a plan view of the closing machine.

As shown in FIGS. 5 and 6, the work piece introducing device 10 comprises a guide rail 121 extending in the Y axis direction for conveying the work piece 9, a sliding table 122 supported slidably on the guide rail 121, and an air cylinder 123 for causing the sliding table 122 to reciprocate in the Y axis direction. The inner diameter chuck 8 is joined to the sliding table 122. The air cylinder 123 moves the inner diameter chuck 8 in accordance with the output of a controller not shown in the figure, and is stopped in an instructed position.

The closing machine 1 comprises an introducing table 131 on which the work piece 9 to be transported by the conveyors 18 is placed. The introducing table 131 supports the work piece 9 on substantially the same axis as the inner diameter chuck 8.

The closing machine 1 comprises an air cylinder 132 that raises and lowers the introduction stopper 12 in the Z axis direction relative to the introducing table 131. The air cylinder 132 raises and lowers the introduction stopper 12 in accordance with the output of the controller, not shown in the figure, whereby the introduction stopper 12 rises and falls relative to the introducing table 131.

Figure 7:
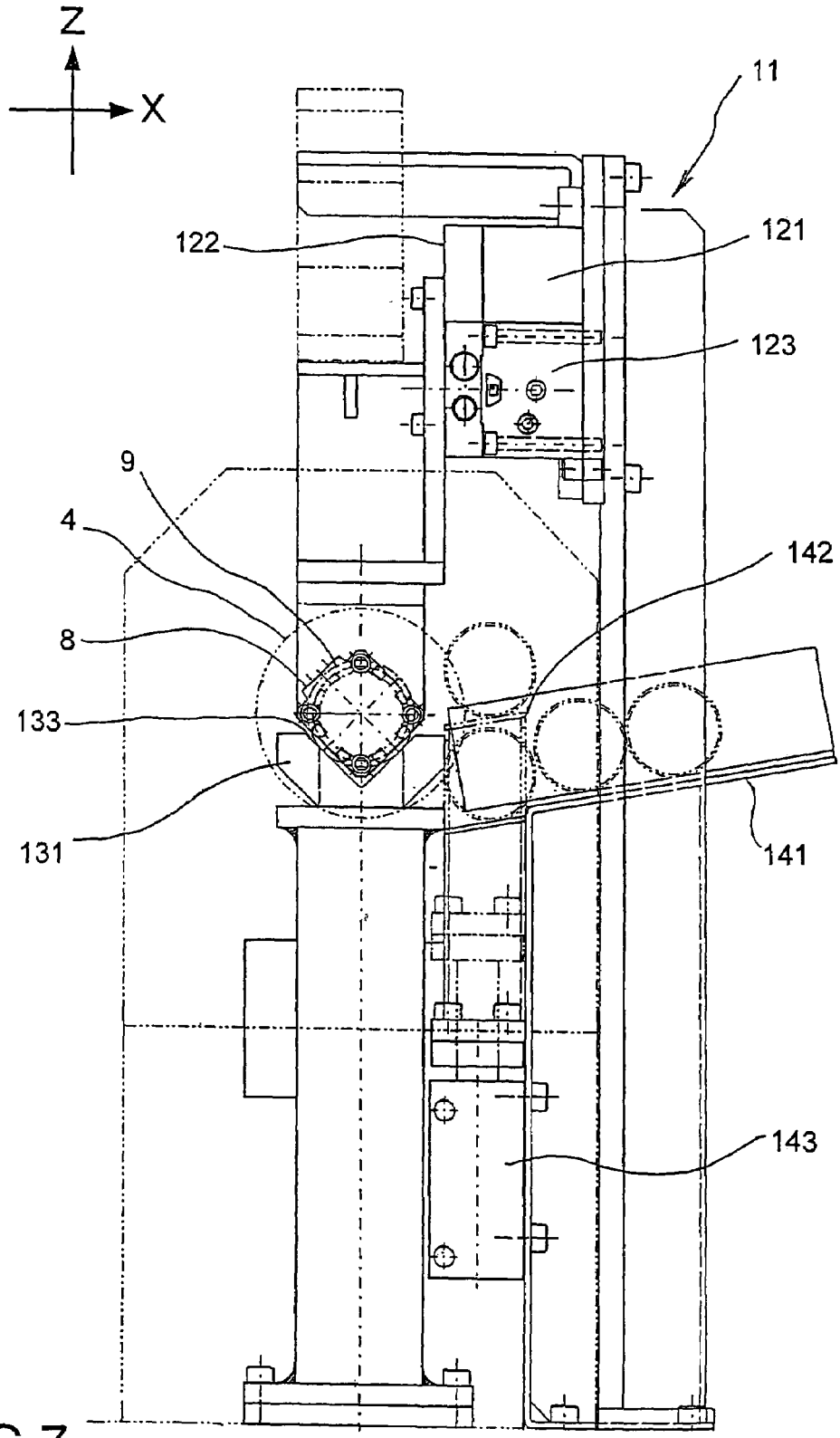
FIG. 7 is a front view of the closing machine.

As shown in FIG. 7, the closing machine 1 comprises an inclined table 141 for transporting the work piece 9 to a point prior to the introducing table 131, a tact maker 142 for pushing up the work piece 9 that has rolled along the inclined table 141, and an air cylinder 143 for raising and lowering the tact maker 142 in the Z axis direction. Every time the tact maker 142 pushes up a work piece 9, the work piece 9 rolls along the tact maker 142 and is deposited into a groove 133 on the introducing table 131.

Figure 8:
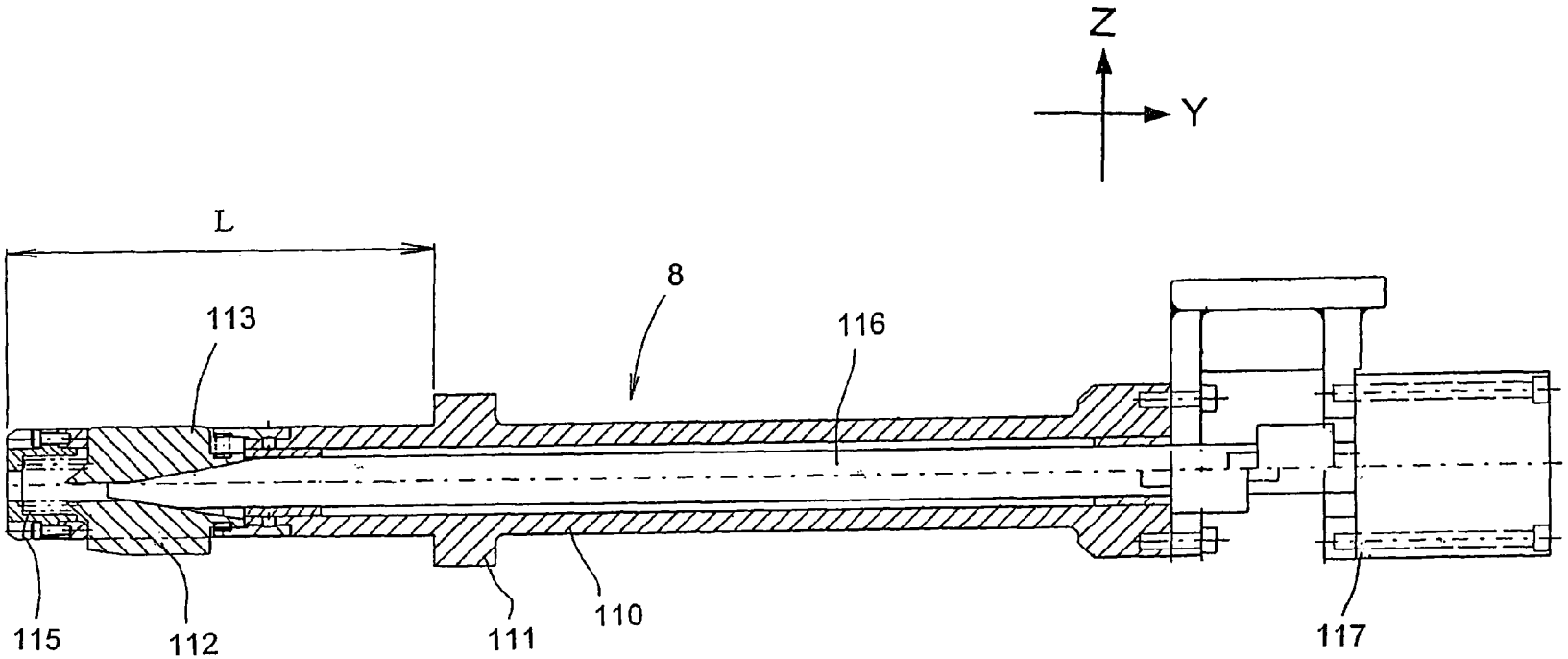
FIG. 8 is a sectional view of an inner diameter chuck.

As shown in FIG. 8, the inner diameter chuck 8 comprises a tubular chuck main body 110 which is inserted into the work piece 9, a chuck stopper 111 which projects from the outer peripheral surface of the chuck main body 110 in ring form, a plurality of chuck members 112, 113 which project sinkably from the outer peripheral surface of the chuck main body 110, a spring 115 which biases the chuck members 112, 113 in a retreating direction, a cam rod 116 which causes the chuck members 112, 113 to project against the spring 115, and an air cylinder 117 which drives the cam rod 116.

When the air cylinder 117 draws in the cam rod 116 in the rightward direction of FIG. 8, the chuck members 112, 113 are drawn into the chuck main body 110 by the biasing force of the spring 115. When the air cylinder 117 moves the cam rod 116 in the leftward direction of FIG. 8, the chuck members 112, 113 project from the outer peripheral surface of the chuck main body 110 against the biasing force of the spring 115 so as to grip the inner peripheral surface of the work piece 9. The air cylinder 117 causes the chuck members 112, 113 to rise and fall in accordance with the output of the controller, not shown in the figure, whereby the work piece 9 is gripped and released.

When the chuck main body 110 is inserted into the work piece 9, the chuck stopper 111 of the chuck main body 110 contacts a tip end portion 9*a* of the work piece 9 such that the work piece 9 is positioned relative to the chuck main body 110.

A work piece insertion length L of the chuck main body 110, extending from the chuck stopper 111 to the tip end side of the chuck main body 110, is set at a larger value than a work piece insertion length by which the work piece 9 is inserted into the outer diameter chuck 7.

As shown in FIG. 4H, the work piece introducing device 10 introduces the inner diameter chuck 8 into the outer diameter chuck 7 such that the inner diameter chuck 8 contacts a bottom portion 9*c* of the processed work piece 9 and pushes the processed work piece 9 out of the outer diameter chuck 7.

A work piece introducing method comprises a process in which the inner diameter chuck 8 grips the inner peripheral surface of the work piece 9 while the work piece 9 abuts against the introduction stopper 12, a process for removing the introduction stopper 12 from the introduction path of the work piece 9, and a process for introducing the work piece 9 into the outer diameter chuck 7 by moving the inner diameter chuck 8.

FIGS. 9A to 9D show processes in which the closing machine 1 introduces the work piece 9 into the outer diameter chuck 7. Each process of this work piece introduction method will now be described in turn.

Figure 9A:
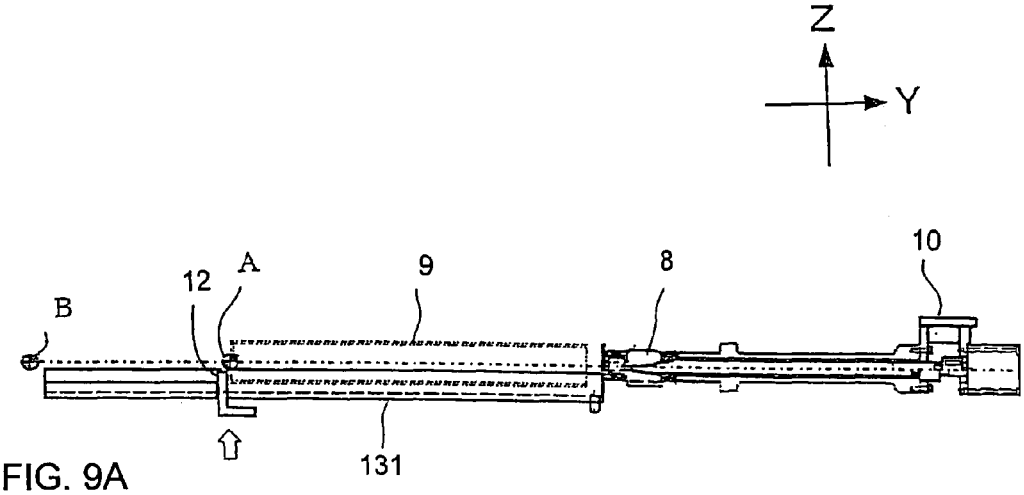
FIGS. 9A to 9D are views showing a work piece introduction process.

As shown in FIG. 9A, the introduction stopper 12 is caused to project, and the work piece 9 is placed on the introducing table 131.

Figure 9B:
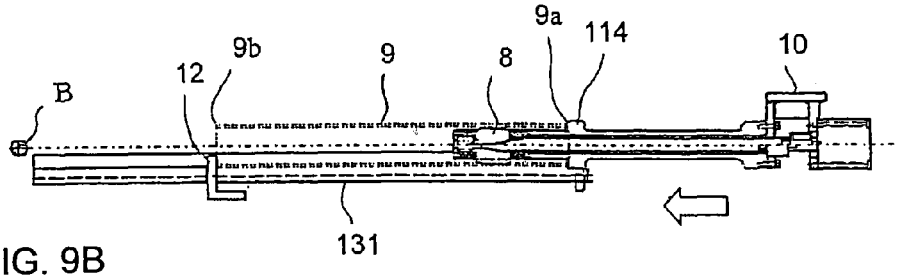

As shown in FIG. 9B, when it is confirmed via a sensor 152, which is shown in FIG. 5, that the work piece 9 is present on the introducing table 131, the work piece introducing device 10 causes the inner diameter chuck 8 to advance in the Y axis direction such that the inner diameter chuck 8 is inserted into the work piece 9. Thus, a base end portion 9*b* of the work piece 9 comes into contact with the introduction stopper 12, and the tip end portion 9*a* thereof comes into contact with the chuck stopper 111. When the base end portion 9*b* of the work piece 9 is in an introduction reference position A, the inner diameter chuck 8 grips the inner peripheral surface of the work piece 9.

Figure 9C:
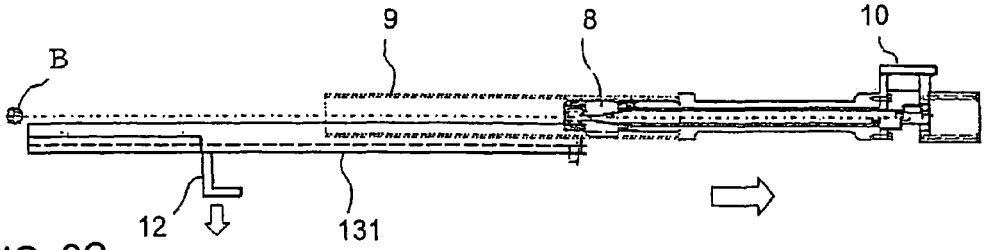

As shown in FIG. 9C, the work piece introducing device 10 then causes the inner diameter chuck 8 to retreat in the Y axis direction such that the introduction stopper 12 is stored.

Figure 9D:
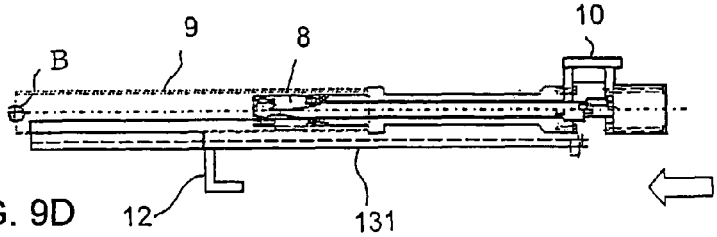

As shown in FIG. 9D, the work piece introducing device 10 then causes the inner diameter chuck 8 to advance in the Y axis direction such that the work piece 9 is inserted into the outer diameter chuck 7, and when the base end portion 9*b* of the work piece 9 is in a gripping reference position B, the outer diameter chuck 7 grips the outer peripheral surface of the work piece 9.

Finally, the work piece introducing device 10 causes the inner diameter chuck 8 to retreat in the Y axis direction such that the inner diameter chuck 8 is removed from the work piece 9.

Next, the actions of the constitution described above will be described.

By means of the constitution whereby the base end portion 9*b* of the work piece 9 comes into contact with the introduction stopper 12, the tip end portion 9*a* thereof comes into contact with the chuck stopper 111, and the inner diameter chuck 8 grips the inner peripheral surface of the work piece 9, the inner diameter chuck 8 can grip the work piece 9 securely in a predetermined position where the base end portion 9*b* of the work piece 9 is in the introduction reference position A.

After the inner diameter chuck 8 has gripped the inner peripheral surface of the work piece 9, the work piece 9 is caused to retreat, after which the introduction stopper 12 is stored. By means of this constitution, an operation to store the introduction stopper 12 can be performed smoothly.

The work piece 9 is introduced into the outer diameter chuck 7 through an operation in which the introduction stopper 12 is caused to fall such that the work piece introducing device 10 causes the work piece 9 to reciprocate on a substantially identical straight line in the Y axis direction. By means of this constitution, the time required to introduce the work piece 9 into the outer diameter chuck 7 is shortened, leading to a reduction in the tact time.

The work piece introducing device 10 inserts the work piece 9 into the outer diameter chuck 7 by causing the inner diameter chuck 8 to advance in the Y axis direction in a predetermined stroke, whereupon the outer diameter chuck 7 grips the outer peripheral surface of the work piece 9. Thus, the outer diameter chuck 7 can grip the work piece 9 securely in a predetermined position where the base end portion 9*b* of the work piece 9 is in the gripping reference position B.

By increasing the positional precision with which the outer diameter chuck 7 grips the work piece 9 in this manner, positional deviation of the work piece 9 in the Y axis direction relative to the die 4 and the core 5 during a closing operation is suppressed. As a result, the tip end portion 9*a* (bottom portion 9*c*) of the work piece 9 can be narrowed to a predetermined shape, the processed shape of the work piece 9 can be kept constant, and the quality can be improved.

When work pieces 9 are processed continuously, the work piece introducing device 10 brings the base end portion 9*b* of an unprocessed work piece 9 into contact with the bottom portion 9*c* (tip end portion 9*a*) of a processed work piece 9 so that the processed work piece 9 is pushed out of the outer diameter chuck 7, as shown in FIG. 4B. By means of this constitution, an operation to introduce a work piece 9 into the outer diameter chuck 7 is performed at the same time as an operation to remove a work piece 9, enabling a reduction in the time required to insert and remove the work piece 9 into/from the outer diameter chuck 7 and a corresponding reduction in the tact time.

As shown in FIG. 4H, when processing of the work piece 9 is complete, the work piece introducing device 10 causes the inner diameter chuck 8 to advance in the Y axis direction to a position in the interior of the outer diameter chuck 7. Thus, the inner diameter chuck 8 comes into contact with the bottom portion 9*c* (tip end portion 9*a*) of the processed work piece 9 such that the processed work piece 9 is pushed out of the outer diameter chuck 7. By means of this constitution, the need for a special tool or the like for pushing the processed work piece 9 out of the outer diameter chuck 7 is eliminated, enabling structural simplification of the closing machine 1.

It should be noted that the outer diameter chuck to which the present invention is applied is not limited to a structure for gripping the outer peripheral surface of a work piece, and may be a jig having a different structure for holding an introduced tubular work piece.

INDUSTRIAL APPLICABILITY

The closing method and closing machine of this invention are not limited to a closing operation such as that described above, for closing an open end of a work piece, and may be used in a spinning operation to reduce the diameter of a work piece by pressing a die against the rotating work piece.

The invention claimed is:

1. A closing method for closing an open end of a tubular work piece by holding the work piece by an outer diameter chuck, rotating the outer diameter chuck together with the work piece, and pressing a die against the work piece rotating about an axial center, comprising:

positioning the work piece in a predetermined position using a retractable introduction stopper which protects onto an introduction path from the predetermined position towards a position in which the outer diameter chuck holds the work piece;

gripping an inner peripheral surface of the work piece by an inner diameter chuck in the predetermined position;

moving the inner diameter chuck by a work piece introducing device along the introduction path from the predetermined position towards the position in which the outer diameter chuck holds the work piece, in a state where the inner peripheral surface of the work piece is gripped by the inner diameter chuck and the retractable introduction stopper is retracted from the introduction path.

2. A closing machine for closing an open end of a tubular work piece by holding the work piece by an outer diameter chuck, rotating the outer diameter chuck together with the work piece, and pressing a die against the work piece rotating about an axial center, comprising:

a retractable introduction stopper which positions the work piece in a predetermined position by projecting onto an introduction path from the predetermined position towards a position in which the outer diameter chuck holds the work piece;

an inner diameter chuck that grips an inner peripheral surface of the work piece in the predetermined position;

a work piece introducing device that moves the inner diameter chuck along the introduction path from the predetermined position towards the position in which the outer diameter chuck holds the work piece, in a state where the inner peripheral surface of the work piece is gripped by the inner diameter chuck and the retractable introduction stopper is retracted from the introduction path.

3. The closing machine as defined in claim 2, wherein the inner diameter chuck is configured to grip the inner peripheral surface of the work piece and the work piece introducing device is configured to move the work piece to allow the introduction stopper to be retracted from the introduction path.

4. The closing machine as defined in claim 2, wherein the work piece introducing device is configured to move the inner diameter chuck gripping an inner peripheral surface of a pre-closing work piece along the introduction path until a base end portion of the pre-closing work piece abuts against a tip end portion of a closed work piece so as to push the closed work piece out of the outer diameter chuck.

5. The closing machine as defined in claim 2, wherein the work piece introducing device is configured to move the inner diameter chuck to a position on an inside of the outer diameter chuck, and the inner diameter chuck is configured to abut against a tip end portion of a closed work piece such that the closed work piece is pushed out of the outer diameter chuck.

* * * * *